United States Patent [19]

Mizuma et al.

[11] 4,119,764

[45] Oct. 10, 1978

[54] HELICAL REINFORCING BAR FOR STEEL CAGE IN CONCRETE STRUCTURE

[75] Inventors: Katsuhisa Mizuma, Fujisawa; Tetsuro Awazu, Chigasaki, both of Japan

[73] Assignee: Neturen Company Ltd., Tokyo, Japan

[21] Appl. No.: 744,447

[22] Filed: Nov. 23, 1976

[51] Int. Cl.[2] ..... E04C 5/06

[52] U.S. Cl. ..... 428/592; 52/737

[58] Field of Search ..... 425/592; 52/737

[56] References Cited

U.S. PATENT DOCUMENTS

| | | | |
|---|---|---|---|
| 2,405,274 | 8/1946 | Sitites | 428/592 |
| 3,187,466 | 6/1965 | Zerr | 428/592 X |
| 3,979,186 | 9/1976 | Mizuma | 428/592 X |

*Primary Examiner*—Richard E. Schafer

[57] ABSTRACT

A steel spiral reinforcing rod which is a high-strength bar having a yield strength of over 55kg/mm$^2$ and with the spiral grooves in the surface thereof, which after being wound into a spiral having the desired dimension can be axially compressed for delivery to the construction site, and when released from the fully-compressed state, the coil will expand to the desired due to its own elasticity and will not suffer plastic deformation even if stretched by an external force. For easy workability, the steel bar is heated in a heating furnace or an induction-heating coil to a specified temperature and then wound in the heated state on a winding machine of specified configuration into spiral form with the coils at the desired pitch. When the bar made of a material which is relatively easy to work, it is desirable that helical winding be done by cold working, followed by heating to a specified temperature in a furnace to remove the stress developed in the bar when it is worked.

4 Claims, 13 Drawing Figures

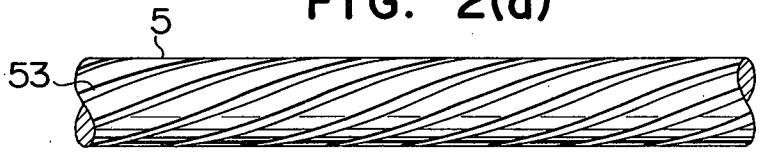
FIG. 2(a)
FIG. 2(b)
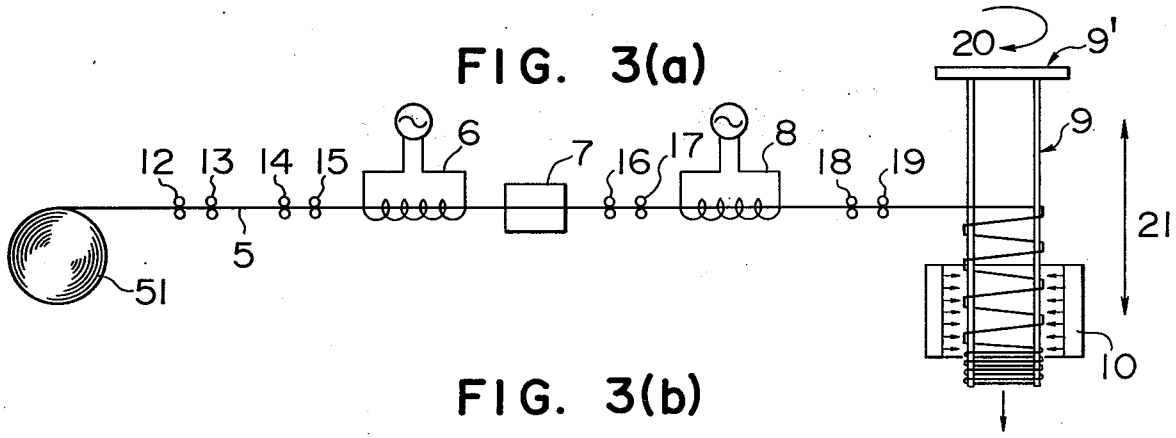
FIG. 3(a)
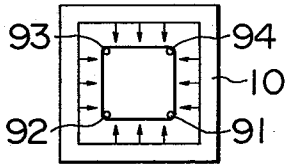
FIG. 3(b)

HELICAL REINFORCING BAR FOR STEEL CAGE IN CONCRETE STRUCTURE

The present invention relates to a steel spiral reinforcing rod used as a stirrup or hoop in a reinforced concrete structure.

BACKGROUND OF THE INVENTION

The reinforcement of a reinforced-concrete structure to enhance the strength of the structure usually consists of longitudinal principal bars and reinforcing forcing steel in the form of stirrups or hoops wound around the longitudinal principal bars. The reinforcing steel serves to prevent rupture of the concrete and buckling of the longitudinal principal bars due to the longitudinal principal bars being displaced in a direction normal to the axis thereof by an axial compressive force.

In the arrangement of the reinforcing steel work, the reinforcing bars are conventionally wound around the longitudinal principal bars as a stirrup or hoop as follows: first length of reinforcing bar is cut for matching the periphery of the longitudinal bars to be strengthened. The cut lengths are manually wound one after another around the longitudinal principal bars and they are fixed to the latter by binding. By repeating this process a number of stirrups or hoops are bound at specified intervals, and the steel work is finally anchored as a reinforcement in the concrete structure. Thus the stirrups or hoops are each an independent bar.

This method of manually winding one piece after another as the stirrup or hoop around the longitudinal principal bars to form the steel work is an extremely primitive and inefficient one. Besides, in a reinforced-concrete column for instance, when the column is under loading the longitudinal principal bars and the ambient concrete tend to be displaced in a lateral direction by an axial compression or seismic force, the loop portion of the hoop steel tends to slip out of the concrete, and the restraint for the longitudial principal bars and concrete provided by the hoop steel fails and in consequence a buckling of the longitudial principal bars leads to rupture of the concrete.

To avoid such problems, use of a helical bar for reinforcing has been proposed. Namely a long bar of the same quality material as a conventional reinforcing bar is bent so as to form an identical loop continuously or coiled and successively folded to form a continuous spiral. Use of a helical bar for reinforcing eliminates the step of manually winding one piece after another of the reinforcing bar around the longitudinal principal bars and fixing them thereto. The construction of the steel reinforcing becomes that much more efficient.

In the proposed method however, it is difficult in the field to make sure that the reinforcing steel hoop is fixed with a specified pitch at a specified position around the principal bars because the spiral steel in this case is a reinforcing bar of the same quality material as the conventional reinforcement but is in a folded state. Therefore when it is stretched out, it develops plastic deformation and it requires considerable time and labour to stretch it to a desired uniform pitch around the principal bars. For instance, to construct a steel cage 3m high, 700mm square, having coils at a 200mm pitch each of which is a square hoop 13mm in diameter as a conventional reinforcement for a column, the spiral or coil is compressed and then stretched again, and as a result a residual deformation is observed. Such a spiral or coil weighs as much as 44kg and it is a tremendous job to coil such a heavy bar around the principal bars while on a high scafolding and while making a pitch correction. In the present practice, such a spiral bar which is as long as 3mm is divided into several parts to reduce the weight which must be handled, and sometimes a special hanger must be provided. As a result, poor workability, low efficiency and poor economy are unavoidable.

Moreover, as mentioned above, in a concrete structure with a steel cage buried therein the axial compressive force can be resisted by the concrete, while the tensile force which can be withstood is governed by the principal bars; and the main role of the reinforcing hoops is to strengthen the longitudinal principal bars, and speaking in terms of architectural dynamics or structural dynamics it cannot be said that due attention has been paid to resistance to force in a direction normal to the bar axis or the shearing force. This is a very real problem when the concrete structure is a structural member of an aseismic building.

OBJECT AND BRIEF SUMMARY OF THE INVENTION

Accordingly, the first object of the present invention is to provide a helical reinforcing bar to serve as a stirrup or hoop for a steel reinforcing structure for a reinforced concrete structure, which helical reinforcing bar can stretch due to its own elasticity when released from a fully-compressed state and which does not undergo plastic deformation even if stretched by an external force and accordingly can be stretched so that the spires of the coil are at a specified pitch with no irregularity in the pitch and this desired pitch can be maintained over the entire length of the helical reinforcing bar.

The second object of the present invention is to provide a helical reinforcing bar for a steel reinforcing cage for a reinforced concrete structure, which is strong enough to have ample resistance to compression and tension in the axial direction of the structure and shearing force in a direction normal to the axis of the structure.

The third object of the present invention is to provide a helical reinforcing bar for a steel reinforcing cage for a reinforced concrete structure, in which because the contact with the principal bar group is stable, the helical reinforcing bar can be stretched smoothly and after it is stretched, the principal bar group and the helical reinforcing bar can be held in integral contact with each other, whereby the bonding with the concrete can be very good.

The fourth object of the present invention is to provide a helical reinforcing bar which, because it has a high-strength, can be made smaller in diameter than a conventional bar so that it is light in weight and highly workable and easy to carry and place in position, and yet can develop the same strength in the concrete structure as a conventional bar.

These objects can be reliably attained by the present invention.

The present invention comprises a helical reinforcing bar having spiral grooves on the surface thereof and a yield strength of more than 55 kg/mm$^2$ and which can stretch to a specified degree due to its own elasticity when released from a fully compressed state and which does not undergo plastic deformation even if stretched by an external force. The helical reinforcing bar according to the present invention is manufactured preferably by heating the bar to a specified temperature in a furance or an induction heating coil helically winding it in the heated state on a winding machine with the individual spires at a specified pitch; then cooling it in the air or, if necessary, by using a cooling means. If thereby the bar has not attained the desired strength according to the present invention, said bar is preferably worked into a helical form after a specified heat treatment. When the bar with the spiral groove thereon is of such a material that it is relatively easy to work, it is desirable that the helical winding be done by cold working, followed by heating to a specified temperature in a heating furnace to remove the stress developed in the bar during the cold working. The above described manufacturing method assures a accurate, and easy working high-strength helical reinforcing bar which can be exactly wound on the longitudinal bars at a desired pitch.

Other objects, features and advantages of the present invention will become more apparent from the following detailed description made in conjunction with the attached drawings.

BRIEF DESCRIPTION OF THE DRAWINGS

In the drawings.

FIG. 1 (*b*) is a longitudinal section of FIG. 1 (*a*).

FIG. 1 (*c*) is a longitudinal section showing a reinforced concrete column with a conventional helical reinforcing bar.

FIG. 2 (*a*) is a front elevation view showing the configuration of a helical reinforcing bar according to the present invention.

FIG. 2 (*b*) is a section transversely of the bar of FIG. 2 (*a*).

FIG. 3 (*a*) is a schematic elevation view illustrating the method of manufacturing a helical reinforcing bar according to the present invention.

FIG. 3 (*b*) is a plan view showing the relation between the winding machine and the cooling mechanism in FIG. 3 (*a*).

FIG. 7 (*b*) is an end view of the specimen beam in FIG. 7 (*a*).

THE DETAILED DESCRIPTION OF THE INVENTION

First with reference to FIGS. 1 (*a*)-(*c*), a brief description of a conventional reinforced-concrete column will be given.

Figure 1A:
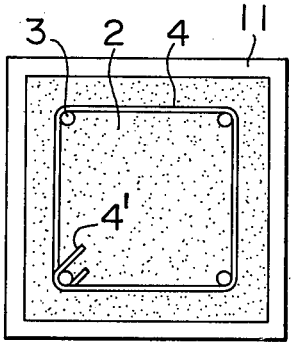
FIG. 1(a) PRIOR ART
FIG. 1 (*a*) is a plan view showing a reinforced concrete column manufactured by the conventional method.
Figure 1C:
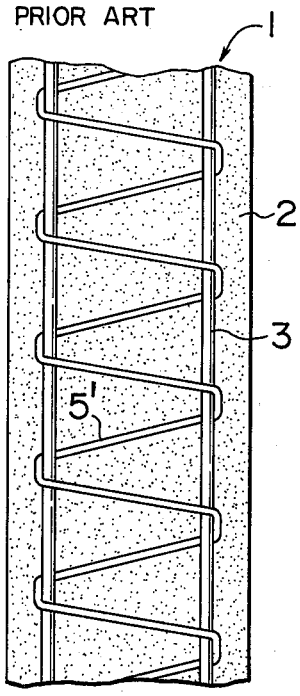
FIG. 1(c) PRIOR ART
Figure 1B:
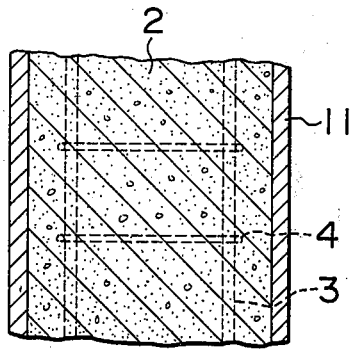
FIG. 1(b) PRIOR ART

In FIGS. 1 (*a*) and 1 (*b*), longitudinal principal bars 3 are provided in an arrangement having a cross-sectional pattern such as a square and are positioned near the periphery of a column. A series of reinforcing bars are cut to a length substantially the same as the periphery of the pattern of the longitudinal principal bars, and the pieces are individually bent as hoop reinforcements around the principal bars at specified intervals therealong. The end 4' of each reinforcing bar 4, after being bent around the longitudinal principal bars is bent toward the center of the column. The steel reinforcing cage constituted by the longitudinal principal bars 3 and the surrounding reinforcing bars 4 is placed in a form 11 and concrete 2 is poured into the form. When the concrete acquires the required strength, the form is removed, leaving a reinforced-concrete column.

As pointed out above, in this method the winding of the individual reinforcing bars is very inefficient; besides, the restraint of the longitudinal principal bars 3 by the reinforcing bars 4 is liable to be easily lost.

FIG. 1 (*c*) illustrates an example of a helical bar 5' used for reinforcing purposes. The method illustrated in FIG. 1 (*c*) is free from the drawbacks in the method illustrated in FIGS. 1 (*a*) and 1 (*b*), but it has different drawbacks in that it becomes difficult to wind the reinforcing bar around the longitudinal principal bars 3 over the whole length of column with the individual spires at a specified uniform pitch when the reinforcing bar 5' is of a material such as is used for a conventional bar. When the helical bar is not wound around the longitudinal principal bars with the spires at a specified uniform pitch over the entire length, the restraint of the longitudinal principal bars and the concrete by the helical reinforced bar will not be proper and accordingly the bonding between the concrete and the longitudinal principal bars will fail with the result that the longitudinal principal bars will not perform their function. As described above, assume that a helical bar 13mm in diameter is bent into a coil with spires 700mm square and at a 200mm pitch. If the bar is of a conventional quality material, residual deformation is unavoidably developed when the bar is worked to a 200mm pitch at the plant, compressed, bound, carried to the field and there unbound.

According to the result of an experiment carried out by the inventor, for the purpose of avoiding development of residual deformation in a helical bar having the spires at a 200mm pitch and used for reinforcement in the construction of a 600mm diameter steel cage it was necessary to set the yield strength at 25.2kg/mm$^2$ for a bar of 9mm diameter and at over 35.36kg/mm$^2$ for a bar of 13mm diameter; in the construction of a 500mm diameter steel cage using a helical bar with the spires at a 200mm pitch it was necessary to set the yield strength at 34.8kg/mm$^2$ for a bar of 9mm diameter, at 50kg/mm$^2$ for one of 13mm diameter; and in the construction of 400mm diameter steel cage the yield strength had to be 56kg/mm$^2$ for a bar of 9mm diameter and over 77kg/mm$^2$ for one of 13mm diameter. Otherwise a deformation develops and pitch correction has to be made on account of a pitch error developed when stretching the helical so that the spires are at the desired pitch. To correct the pitch irregularity, a force of 43kg was required in the construction of a steel cage for a concrete column 3m high and 500mm in diameter using a helical bar of about 13mm diameter. Even though a force of 43kg sufficed for the correction, an exact correction of pitch was practically impossible; further the work of pitch correction on a high scaffolding was dangerous.

The present invention firstly aims at eliminating the drawback described above when using a helical bar for reinforcing purposes. Generally speaking to remove the residual stress in the helical reinforcing bar, the easiest way is by making the diameter of the bar as small as possible. However, the reinforcing bar is intended, as described above, for restraining the longitudinal bars and the concrete so as to prevent the longitudinal principal bars from buckling as a result of being displaced in a direction normal to the axis of the structure by an axial compressive force, and accordingly the reinforcing bar must have a strength high enough to attain this purpose. Thus when a smaller diameter reinforcing bar is used its strength must be proportionately increased.

According to the present inventor's calculations, if a helical reinforcing bar 13mm in diameter (sectional area 132.7mm$^2$) having a coil diameter of 500mm and made of a steel commonly used for concrete reinforcing rods (yield strength 24kg/mm$^2$) is to be replaced by a steel bar having a diameter of 7mm, (sectional area 38.5mm$^2$) a chemical composition as shown in Table 1, according to this invention and which permits easy correction of pitch, the yield strength required for the reinforcing bar to restrain the longitudinal principal bars is 24kg/mm$^2$ $\times$ 132.7mm$^2$/38.5mm$^2$ = 82.7kg/mm$^2$. To replace a 500mm diameter coil of a helical reinforcing bar 9mm in diameter (sectional area 63.6mm$^2$) with one 6mm in diameter (sectional area 28.3mm$^2$) with the same chemical composition as above a yield strength of 24kg/mm$^2$ $\times$ 63.6mm$^2$/28.3mm$^2$ = 53.9kg/mm$^2$ was needed. Thus if a 500mm diameter coil is to be wound using the bar 6mm diameter, the bar to be used will be required to have a yield strength of more than 55kg/mm$^2$. In that case, however, it will not be satisfactory simply to make the yield strength high. It would be poor economy to increase needlessly the yield strength and correspondingly decrease excessively the size of the bar, because in that case the bar would suffer too much strain and the concrete, which cannot accommodate such a strain, would rupture.

Table 1

| Chemical composition (%) | | | |
|---|---|---|---|
| C | Mn | P | S |
| — | — | less than 0.050 | less than 0.050 |

Note: Content of C and Mn are not specified.

From the two conditions to be satisfied, namely that the restraint on the concrete by the reinforcing bar be maintained at a practically satisfactory level and that the quality of the material not deteriorate from a temperature rise of up to 450° C, such as from a fire, the upper limit of the yield strength of the helical reinforcing bar is preferably about 130kg/mm$^2$ for the present invention.

In the foregoing, the yield strength of the reinforcing bar which is necessary to restrain the longitudinal principal bars has been considered for the situation where the bar is replaced with one of smaller diameter for obtaining better workability.

Next is considered what yield strength the bar must possess in order that no residual deformation will develop therein.

The result of a calculation has revealed that when a 400mm diameter 3m long helical bar is stretched until the spires are at a 200mm pitch after it has been fully compressed, the yield strength will have to be 45kg/mm$^2$ if residual deformation is not to be permitted to develop. Accordingly by setting the lower limit of the yield strength of the helical reinforcing bar at about 55kg/mm$^2$, there can be secured at the same time the effect, conventionally sought after, of preventing the buckling of the longitudinal principal bars and the effects of avoidance of residual deformation when the bar is stretched so that the spires are at a specified interval after the helical bar has been fully compressed following close-fit winding and the production of a desired uniform pitch over the entire length of the longitudinal bars by merely stretching the helical bar to a specified length, as well as the effect that the helical rod is lighter and has better workability.

According to the results of various experiments conducted on the helical reinforcing bar according to the present invention, when yield strength of the helical bar is in the range of 55kg/mm$^2$ - 130kg/mm$^2$, the above effects can be perfectly attained even with different helical bar coil diameters, pitch of the spires or diameters of the bar.

The present invention provides an effective helical reinforcing bar for a reinforced-concrete structure which meets the above described requirements.

On the other hand, even if the helical bar possesses sufficient yield strength in the range described above, thereby being able to provide ample restraint of the longitudinal principal bars, and it has improved workability so that merely by stretching it from the fully-compressed state, the spires will be at a generally uniform desired pitch over the whole length of the concrete member, there will be no restraint of the longitudinal principal bars and the longitudinal principal bars will be liable to buckle, unless a satisfactory bond is established between the helical reinforcing bar and the concrete.

According to the present invention, the helical reinforcing bar 5 is provided with external spiral grooves 53 to meet such requirement.

FIGS. 2(*a*) and 2(*b*) illustrate an example of a bar according to the invention with external spiral grooves 53 therein over the whole length of the bar.

As means to improve the bondability to the concrete it is also possible to deform the bar by forming convex projections on its external surface, but in that case the helical reinforcing bar will contact the longitudinal bars through these convex projections, with the result that the contact surface is not smooth and stable and the restraint of the helical bar on the longitudinal principal bars is adversely affected.

To assure the smoothness and stability of the contact surface, a round bar may be used, but an improved bondability of the bar to the concrete cannot be achieved thereby. By contrast, if the bar is deformed by the spiral grooves 53 therein as in the present invention, the contact with the longitudinal principal bars will be stabilized; and the bondability to the concrete will be improved, thereby assuring stable, firm restraint of the longitudinal principal bars by the helical bar.

Next the method of manufacturing the helical reinforcing bar according to the present invention will be described.

The helical reinforcing bar of the present invention, having such a high strength, is hard to work at an exact pitch by the conventional method of winding. FIGS. 3(*a*) and 3(*b*) illustrate a method of manufacturing a high strength helical bar for use in the present invention and which is extremely easy to work.

In FIGS. 3(*a*) and 3(*b*), a coil 51 of steel bar preliminary cold-drawn to form the spiral grooves therein and then coiled and which can have its strength increased through heat treatment, is uncoiled along a specified path by a feeding device, for instance, the pinch-rollers 12 - 19 which are conventional in the prior art.

An uncoiled bar 5, after being heated to an ordinary hardening temperature for a specified time by, say, an induction-heating coil 6, is cooled and hardened in a cooling mechanism 7 which is conventional in the prior art. Thereupon, the wire is heated in a further induction heating coil 8 for a specified time to an ordinary tempering temperature, say, 350° - 400° C, and the wire heated to the tempering temperature is wound on a winding machine 9.

In FIG. 3(*b*) is illustrated an arrangement of the winding machine 9 for constructing a steel helical reinforcing bars having square spires. Frames 91–94 are secured at one end to the plate 9' at the corners of a square so that their positions will be maintained. The winding machine 9 is turned in the direction 20 at a preset speed and at the same time is displaced in the direction 21 by means of a rotation-drive mechanism and a reciprocating mechanism conventional in the art. Therefore when the turning in the direction 20 and the displacement in the direction 21 of said winding machine 9 are properly set, the bar 5 heated to a tempering temperature will be wound in a helix around the frames 91–94 of the machine 9, and easily worked into a helical bar having square spires. After being worked into the helical form the part of the bar thus helically formed is moved into the cooler 10 by the rotation and longitudinal displacement of the winding machine 9, where it is cooled with jets of a cooling liquid issuing from circumferentially spaced nozzles. With this cooling the winding as well as the tempering of the bar is finished, yielding a high-strength helical bar having spires of a square shape and strengthened through heat treatment.

After completion of the winding of one coiled helical bar by the winding machine 9, the rotation and displacement of said machine 9 are stopped; the power supply to the induction-heating coils 6 and 8 is cut off; the helical bar coiled on the winding machine 9 is taken off the winding machine 9; cut at a required number of spires, fully compressed; and then the spires are bound together in the fully compressed state. Although it is not shown in the drawing, if the motion of the winding machine 9 is restricted to rotation in the direction 20 and the winding frames 91–94 are successively inclined inward in the direction toward the cooling mechanism, the helical bar can be moved in the direction of the cooling mechanism and after it is cooled, it can be cut into pieces having a desired number of spires, said pieces being sent on to the next steps of fully compressing and binding them.

The above example is for producing a helical bar having spires of a rectangular shape, but a helical bar having spires of a closed geometric shape such as a circular, oval or polygonal shape may be produced by appropriately modifying the arrangement of the frames 91–94. The above example is for a bar worked in a heated condition for tempering and then being cooled in a cooling mechanism 10, but if necessary, the cooling may be done in ambient air instead of using the cooling mechanism 10. Further, when the bar with the helical grooves has sufficient strength as required in the present invention even without hardening, or when the bar has already been hardened, the steps of heating by the induction-heating coil 6 and cooling by the cooling mechanism 7 in FIG. 3(*a*) can be omitted. Then the material has only to be submitted to the stage following the heating by the induction-heating coil 8 or it has only to be worked after having been heated by some method to 300°- 400° C, such as in a furnace or induction-heating coil. In this case, similarly to the above, the hot helical wire may be air-cooled or cooled in a cooling mechanism.

In the above method of production, the working of the helical bar is done while the bar is at a very high temperature, and the winding can be accurately, smoothly and easily carried out; and with the production ending with the cooling, a precisely formed high-strength helical bar can be produced. Meanwhile, through proper selection of the frame arrangement, rotational speed and displacement of the winding machine, a helical bar of the desired pitch and desired profile necessary for the desired steel cage can be produced.

Further, when the bar with the spiral grooves thereon is of such a material that it is relatively easy to work it will be desirable to wind it into a helical form by cold working and thereafter heat it to a specified temperature (300°–400° C), thereby removing the residual stress developed during winding.

Figure 4:
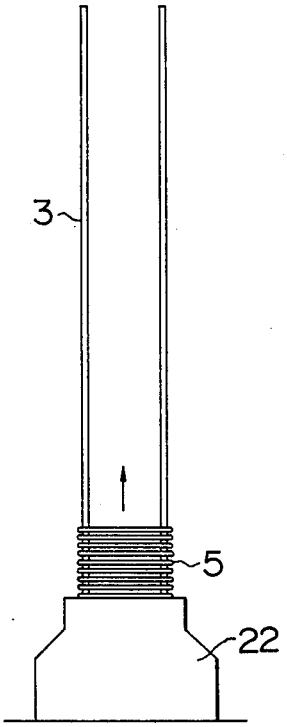
FIGS. 4 and 5 are elevation views illustrating examples of the helical reinforcing bar of the present invention being wound around the longitudinal principal bars arranged in a square cross-sectional pattern.
Figure 5:
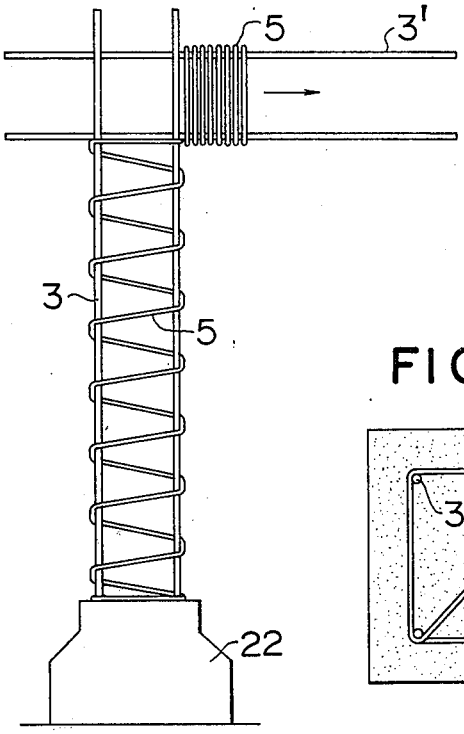

Next, the arrangement of the helical reinforcing bar of the present invention in a reinforced concrete column or a reinforced concrete beam will described referring to FIGS. 4 and 5, which illustrate an example of the arrangement of the helical bar in a square cross-section steel cage.

The helical bar bound up in a fully compressed coil is delivered to the work site. As shown in FIG. 4, the required number of the longitudinal principal bars 3 are erected on a foundation 22 parallel to each other to form a square cross-section cage and the fully compressed helical bar 5 is arranged around the longitudinal principal bars 3.

With the lower end of the helical bar 5 secured to the lower end of the longitudinal principal bars 3, the helical bar 5 is unbound and stretched as indicated in FIG. 5 and at a specified level of the longitudinal principal bars 3 the helical bar 5 is bound around the longitudinal principal bars 3 and fixed. Thereupon a form is erected around the steel cage thus constructed. Next the longitudinal principal beam bars 3' are set at a specified level on the longitudinal principal bars 3 of the column and bound to the longitudinal principal column bars 3 at right angles thereto; in the same fashion a helical bar 5 in a fully compressed state is positioned around the longitudinal principal beam bars 3'; one end of the helical bar is secured to the junction of the longitudinal principal column bars 3 to the longitudinal principal beam bars 3'; thereafter the helical bar 5 is unbound and the other end of it is extended to a specified point along the longitudinal principal beam bars 3'; and the extended end is fixed to the principal beam bar group 3'.

A form is erected around the steel cage of the beam. Then concrete is poured into the forms to make the reinforced column and beam.

The securing of the longitudinal principal column bars and the beam bars and the formation of the forms are by traditional methods and accordingly no detailed description thereof has been given. The bar arrangement for a circular, oval or polygonal steel cage is the same as in the case of the square steel cage.

To verify the effect of the present invention, the present inventor constructed a concrete structure using the helical bar according to the present invention, and carried out a comparison with a similar structure having a conventional bar to show the effect of the yield strength of the helical bar on the shear resistance of the structure.

Some of the experimental data are given below.

1. Experimental conditions
   1) Specimen and its dimension:
      Concrete structure respectively holding the helical bar described in 2) as a shear-reinforcing bar.
      Length: 3300mm
      Sectional area: 400mm × 180mm
   2) Helical steel ratio* in Specimen and diameter and pitch of spires of helical bar.

| | Steel ratio (%) | 0.26 | 0.52 | 0.78 | 1.18 |
|---|---|---|---|---|---|
| Shear-reinforcing bar (helical bar) | Diameter (mm) | 6 | 6 | 9 | 9 |
| | Pitch (mm) | 120 | 60 | 90 | 60 |
| Yield strength of helical bar; | | | | | |
| 30kg/mm² | | | | | |
| 60kg/mm² | | | | | |
| 130kg/mm² | | | | | |

*Note: Helical steel ratio is the ratio of the cross-sectional area of steel to the cross-sectional area of concrete in a unit section of specimen.

3) Profile of helical bar:
      Spiral grooves are formed over its entire length.

| | | |
|---|---|---|
| Diameter (mm) | 6 | 9 |
| Number of grooves | 3 | 6 |
| Width of groove (mm) | 2.8 ± 0.3 | 3.3 ± 0.3 |
| Depth of groove (mm) | 0.3 | 0.4 ± 0.1 |
| Pitch of groove (mm) | 65–80 | 90–110 |

2. Experimental procedure

Figure 7A:
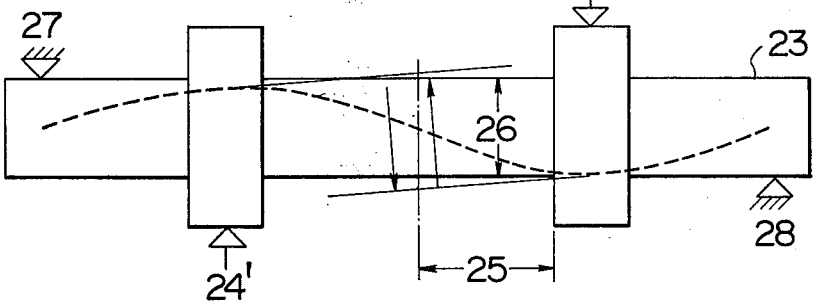
FIG. 7 (*a*) is an elevation view illustrating an experimental procedure conducted with a reinforced concrete beam having therein a helical reinforcing bar according to the present invention.
Figure 7B:
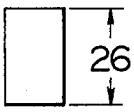

As shown in FIG. 7 the beam 23 was supported at points 29, 28, 24 and 24', and loading was at points 24 and 24' by a 100 ton load cell. In this experiment the ratio of the shear span 25 to beam depth 26 was equal to 1.5, where the shear span 25 is defined as the distance from the center of the beam to the inside face of the loading column. The deformation caused in the specimen was recorded. The ultimate shear stress was determined from the maximum load on the points 24 and 24', and therefrom the relation between the ultimate shear stress and the steel ratio was determined.

3. Experimental results

Figure 8:
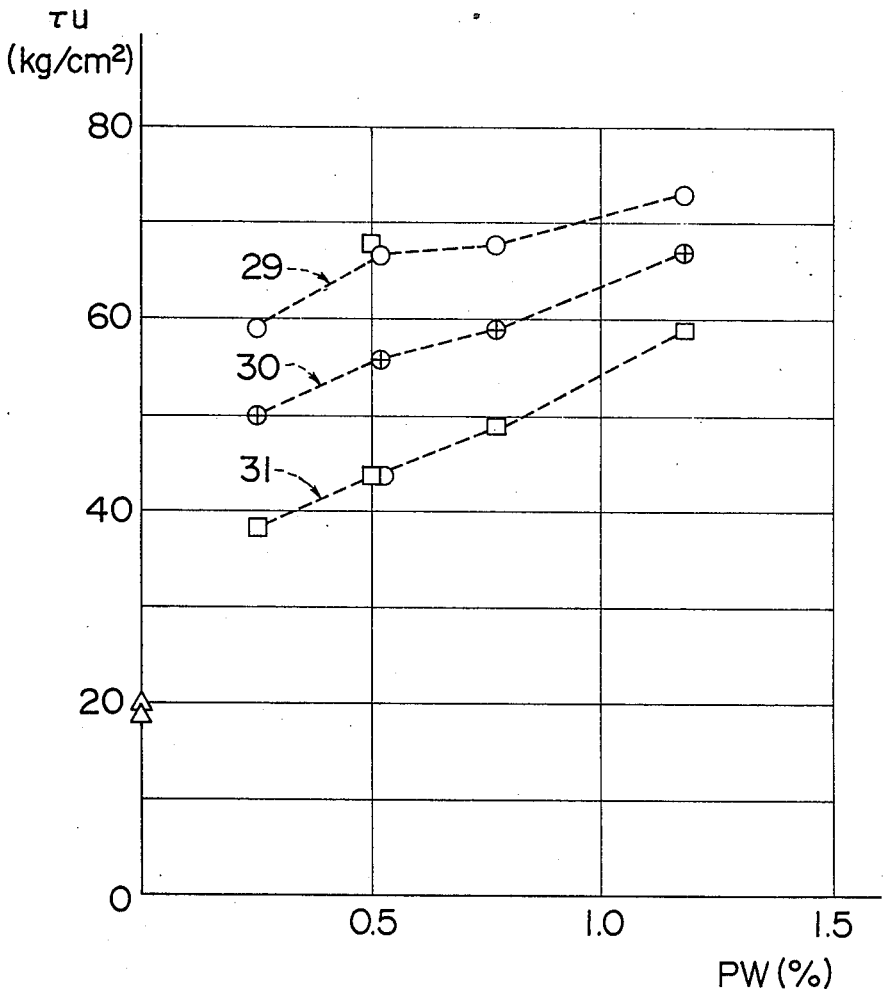
FIG. 8 is a graph summarizing the results of an experiment conducted according to the experimental procedure shown in FIG. 7.

The results are summarized in FIG. 8, in which the ordinate is the ultimate shear stress (kg/cm²) and the abscissa is the steel ratio PW. Curve 29 is for the results from using a helical bar of 130kg/mm² yield strength; curve 30 is for the results from using a helical bar of 60kg/mm² yield strength; and curve 31 is for the results from using a helical bar the yield strength of which is in the range of 25kg/mm² – 30kg/mm², The stress developed in the helical bar during the experiment was measured by an electric wire strain gauge; according to the measurement, at a steel ratio of 0.52%, a maximum strain of 3800μ was developed. From this it can been seen that the helical bar must have a yield strength more than 75kg/mm².

Figure 6:
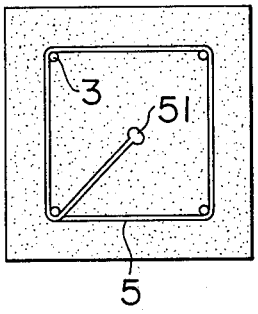
FIG. 6 is a plan view showing the anchor head at the end of a helical reinforcing bar according to the present invention.

In a separate experiment from the above, as indicated in FIG. 6 a button-shaped head 51 was formed at the end of a helical bar of the present invention; said head was buried 15cm deep in concrete having a compressive strength of 210kg/cm²; and then it was submitted to a pull-out test using a conventional pull-out testing machine. The concrete cracked under a load 2.5 times as great as in the case of a bar with no such a head, while when the head was buried at a depth of 20cm, the concrete cracked under a load 4 times as great as for no head. Thus provision of a button-shaped head 51 makes it possible to manufacture a reinforced concrete member which resists large loads. The end of the helical bar is preferably bent around the relevent principal bars such that the head 51 will be nearly at the midpoint of the cross-section of the column or beam, in which case the anchor will be reliable.

1. The helical reinforcing bar according to the present invention can stretched so that the spires are at a specified pitch due to its elasticity when released from the fully-compressed state and it does not suffer plastic deformation even when stretched after being delivered to the work site in fully-compressed state. Therefore a desired substantially uniform pitch of the spires can be maintained over the length of the entire concrete member by fixing one end of the compressed coil, then stretching the coil and thereafter fixing the coil to the longitudinal bars at desired intervals. Thus no pitch correction is necessary such as has been required for conventional helical bars having a yield strength between 25–30kg/mm².

2. In the present invention as shown in the above experimental data, by setting the yield strength of the helical bar in the range of 55kg/mm² – 130kg/mm², which is 2–4 times as high as that of conventional reinforcing bar yield strengths of 25–30kg/mm², the development of strain can be controlled within the practically tolerable limits and the ultimate shear stress can be made to extremely high. Thus the restraint of the longitudinal principal bars and concrete by the helical bar of this kind can be enhanced, thereby, together with the increased bondability to the concrete, preventing buckling of the longitudinal principal bars and rupture of the concrete due to an axial compression in the reinforced concrete structure. In addition an ample resistance to the tension in a direction normal to the axis of the structure can be imparted to the longitudinal principal bars, thereby enabling the construction of an excellent aseismic structure.

3. In the helical reinforcing bar according to the present invention, in which helical grooves are formed thereon, when the bar is coiled around the longitudinal principal bars, it will contact the longitudinal principal bars in a stable manner and the spiral grooves improve the bondability of the bar to the concrete, thereby assuring a reliable restraint of the longitudinal principal bars.

4. The conventionally used reinforcing bar of this kind has a diameter of 9mm or 13mm and a yield strength in the range 25–30kg/mm², but the bar employed in the present invention has a yield strength more than 2–4 times the above value and accordingly the reinforcing bar can have a greatly reduced diameter for the same size coil. Thus a steel cage far lighter than the conventional one can be constructed. Namely, as compared to a conventional 13mm diameter helical bar with a yield strength of 30kg/mm² with the spires at a 200mm pitch and 3m in length and 700mm square spires for use in a column and which weighs 44kg, a similar size helical bar with a yield strength of 130kg/mm² and 7mm diameter according to the present invention which can perform the same function weighs merely 11kg and is very convenient to transport and handle. On the other hand the aseismic effect of a helical bar according to the present invention will be extremely great as compared with a conventional bar because the same weight of helical bar of the present invention can coil around a given length of the longitudinal principal bars with four times as many turns as a conventional helical bar.

5. Use of a helical bar according to the present invention assures an extremely high value of ultimate shear stress as compared with use of conventional reinforcing bar of the same diameter. It has been experimentally confirmed that the ultimate shear stress in the case of a conventional helical bar of, say, 30kg/mm$^2$ yield strength at a helical steel ratio of 1.18% is equivalent to the ultimate shear stress when using the helical bar of the present invention having 130kg/mm$^2$ yield strength at a helical steel ratio of 0.26%. Thus according to the present invention, the steel ratio can be reduced to $\frac{1}{4}$ of the conventional value for the same ultimate shear stress.

6. If in the helical bar of this invention, a button-shaped head is provided at the end of the bar, a heavier load can be withstood and a better anchoring effect will be achieved than when no button-shaped head is provided.

The above examples are mainly of applications of the helical reinforcing bar of the present invention as the reinforcing bar in a steel cage for reinforced concrete columns and beams, but the helical bar of the present invention is applicable as the reinforcing bar in a steel cage for a prestressed concrete structure as well as for a reinforced concrete structure other than columns and beams.

What is claimed is:

1. A helical reinforcing bar for use as a stirrup or hoop for a steel reinforcing cage for a concrete structure, said bar being a high-strength steel bar having a yield strength of over 55kg/mm$^2$ and being in the form of a helix and having no plastic deformation when the helix is collapsed to a fully-compressed state and which expands to the desired length with the coils at the desired pitch by its own elasticity, whereby the helical reinforcing bar can be compressed to a fully collapsed state and carried in this state to the site where it is to be used, and after being positioned around a group of longitudinal bars which have already been positioned in the desired positions in a reinforced structure, said spiral reinforcing bar is released, and thereupon said spiral reinforcing bar extends itself to a specified length with the same pitch being maintained between coils over the entire length of said extended helical reinforcing bar.

2. A helical reinforcing bar as claimed in claim 1, wherein said bar has a yield strength of from 55 to 130kg/mm$^2$.

3. A helical reinforcing bar as claimed in claim 1, wherein one end of the helical bar has a button-shaped head thereon.

4. A helical reinforcing bar as claimed in claim 1, wherein said bar has spiral grooves therearound.

* * * * *